US009194349B2

(12) United States Patent
Lehtonen

(10) Patent No.: US 9,194,349 B2
(45) Date of Patent: Nov. 24, 2015

(54) FUEL INJECTION ARRANGEMENT FOR PISTON ENGINE

(75) Inventor: Kai Lehtonen, Vaasa (FI)

(73) Assignee: Wärtsilä Finland Oy, Vaasa (FI)

( * ) Notice: Subject to any disclaimer, the term of this patent is extended or adjusted under 35 U.S.C. 154(b) by 1035 days.

(21) Appl. No.: 13/258,905

(22) PCT Filed: Mar. 18, 2010

(86) PCT No.: PCT/FI2010/050210
§ 371 (c)(1),
(2), (4) Date: Nov. 29, 2011

(87) PCT Pub. No.: WO2010/112670
PCT Pub. Date: Oct. 7, 2010

(65) Prior Publication Data

US 2012/0060795 A1 Mar. 15, 2012

(30) Foreign Application Priority Data

Apr. 2, 2009 (FI) ..... 20095363

(51) Int. Cl.
*F02M 69/04* (2006.01)
*F02M 57/02* (2006.01)

(52) U.S. Cl.
CPC ..... *F02M 57/025* (2013.01); *F02M 57/026* (2013.01)

(58) Field of Classification Search
CPC ..... F02M 57/025–57/028
See application file for complete search history.

(56) References Cited

U.S. PATENT DOCUMENTS 4,405,082 A 9/1983 Walter et al.
2003/0168525 A1* 9/2003 Boecking ..... 239/533.2
(Continued)

FOREIGN PATENT DOCUMENTS

EP 0959245 A2 11/1999
EP 1270931 A2 1/2003
(Continued)

OTHER PUBLICATIONS

International Search Report and Written Opinion for PCT/FI2010/050210 dated Jun. 24, 2010.

*Primary Examiner* — Hieu T Vo
*Assistant Examiner* — Arnold Castro
(74) *Attorney, Agent, or Firm* — Heslin Rothenberg Farley & Mesiti P.C.; Victor A. Cardona, Esq.

(57) ABSTRACT

The invention relates to a fuel injection arrangement for piston engine comprising at least one fuel injector by means of which fuel may be injected into a combustion chamber of the engine, the fuel injector comprising at least one fuel injection valve arranged to meter the fuel into the combustion chamber, the fuel injection arrangement further comprising an intensifier piston arrangement comprising a piston space and a piston member therein having a first area which is arranged to be effected by a work fluid and which first area at least partially borders a first work space of the intensifier piston arrangement; and the piston member having a second area which at least partially borders a second work space of the intensifier piston arrangement, the second work space being arranged in flow connection with the at least one injection valve of the injector. The intensifier piston arrangement comprises a counter member and the piston member is provided with a longitudinally extending cavity providing a space into which the counter member is arranged to extend at least partly, and the second area is at least partly defined at least partly by the piston member and the counter member.

15 Claims, 5 Drawing Sheets

(56) References Cited

U.S. PATENT DOCUMENTS

| | | | | |
|---|---|---|---|---|
| 2004/0149265 | A1 | 8/2004 | Magel et al. | |
| 2005/0028788 | A1* | 2/2005 | Shafter et al. | 123/445 |
| 2006/0043209 | A1* | 3/2006 | Magel | 239/88 |
| 2006/0048751 | A1* | 3/2006 | Grimmiger et al. | 123/446 |
| 2007/0175448 | A1* | 8/2007 | Shinogle et al. | 123/447 |
| 2009/0159048 | A1* | 6/2009 | Yamada et al. | 123/447 |
| 2011/0168812 | A1* | 7/2011 | Frasch et al. | 239/533.3 |

FOREIGN PATENT DOCUMENTS

| | | | |
|---|---|---|---|
| EP | 1908952 | A2 | 4/2008 |
| EP | 1908953 | A2 | 4/2008 |

* cited by examiner

FUEL INJECTION ARRANGEMENT FOR PISTON ENGINE

CROSS REFERENCE TO RELATED APPLICATIONS

This application is a national stage filing under section 371 of International Application No. PCT/FI2010/050210filed on Mar. 18, 2010, and published in English on Oct. 7, 2010as WO 2010/112670 and, which claims priority from Finnish application No. 20095363 filed on Apr. 2, 2009, the entire disclosures of these applications are hereby incorporated herein by reference.

TECHNICAL FIELD

The present invention relates to fuel injection arrangement for piston engine comprising at least one fuel injector by means of which fuel may be injected into a combustion chamber of the engine, the fuel injector comprising at least one fuel injection valve arranged to meter the fuel into the combustion chamber, the fuel injection arrangement further comprising an intensifier piston arrangement comprising a piston space and a piston member therein having a first area which is arranged to be effected by a work fluid and which first area at least partially borders a first work space of the intensifier piston arrangement; and the piston member having a second area which at least partially borders a second work space of the intensifier piston arrangement, the second work space being arranged in flow connection with the at least one injection valve of the injector according to the preamble of claim 1.

BACKGROUND ART

In piston engines, particularly in diesel engines, fuel is admitted into a combustion chamber of the engine by means of a fuel injection nozzle(s). Typically fuel injection nozzle comprises a needle the position of which controls the state of the injection. The tip of the needle prevents or allows the flow of the fuel from the gallery to spray opening(s) of the nozzle. The body of the nozzle comprises a fuel gallery into which a fuel conduit, usually a drilling is extending. A common principle of the operation is a spring loaded needle which is opened by the fuel pressure in a fuel gallery. When the needle is lifted against the spring force fuel from the gallery is admitted through injection orifice(s) into the combustion chamber of the engine. The needle is also guided by the nozzle body. Typically the nozzle body is attached to a nozzle holder body by means of which the nozzle is fixed to the engine.

The injection event itself has high impact on combustion of fuel in piston engine, particularly when compression ignited diesel cycle is employed. For example timing of injection start, duration of the injection has significant effect on the combustion process. Particularly the injection pressure has major impact on the formation of fuel fume and thus also on the combustion process. Publication U.S. Pat. No. 4,405,082 discloses a fuel injection nozzle in which an intensifier piston is provided for increasing the pressure of the fuel within the injector. The capability of increasing pressure is limited considerably by the physical size of the injector which is limited by the available space in the cylinder head where the injector is to be installed.

In older generation diesel engines the fuel injection takes place by an injection pump in which fuel is pressurized and delivered to each injection nozzle separately for each injection. Even if the system is reliable in operation this requires substantially long high pressure piping for each individual injector nozzle. Additionally, considering the present emission requirements, the pressure available does not result in desired injection pressure.

Hence, it is a common aim to perform the injection of the fuel at very high pressure, e.g. at a magnitude of 1000 bar and above. A common approach used in diesel engines is a so-called common rail fuel injection system. Publication EP 0959245B1 shows a common rail injection system, the provision of pressure and the injection of fuel are functionally separated from each other. Fuel is fed by means of a high pressure pump into a common pressure supply, from which it is led through separate pipes into the injector of each cylinder. Similarly in this kind of a solution high pressure piping is needed.

Another problem in the common rail injection systems caused by the continuous pressure prevailing in the system is possible leak of the injector in to the cylinder in the case of malfunction of the nozzle. Publication EP1270931B1 shows a fuel system shut-off valve which prevents the leak fuel flow into the combustion chamber by allowing only a limited amount of fuel to flow at a time.

An object of the invention is to provide a fuel injection nozzle in which the injection performance is considerably improved.

DISCLOSURE OF THE INVENTION

Objects of the invention are substantially met by a fuel injection arrangement for piston engine comprising at least one fuel injector by means of which fuel may be injected into a combustion chamber of the engine, the fuel injector comprising at least one fuel injection valve arranged to meter the fuel into the combustion chamber, the fuel injection arrangement further comprising an intensifier piston arrangement comprising a piston space and a piston member therein having a first area which is arranged to be effected by a work fluid and which first area at least partially borders a first work space of the intensifier piston arrangement; and the piston member having a second area which at least partially borders a second work space of the intensifier piston arrangement, the second work space being arranged in flow connection with the at least one injection valve of the injector. The intensifier piston arrangement comprises a counter member, and the piston member is provided with a longitudinally extending cavity providing a space into which the counter member is arranged to extend at least partly, and that the second area is at least partly defined by the piston member and the counter member. It is characteristic to the invention that the second work space is defined by the cavity in the piston member and the counter member and the second work space is arranged inside the piston member.

In this way the intensifier piston arrangement consumes a considerably small space and makes it possible to locate the intensifier piston arrangement more freely in the fuel feeding system. Since the intensifier piston arrangement is considerably small of its size the intensifier piston arrangement is according to a preferred embodiment of the invention arranged in the fuel injector.

Preferably the piston member has a cylindrical body comprising a first end and a second end into which second end a longitudinally extending cavity is arranged providing the second work space.

According to an embodiment of the invention the contact area between the piston space inner wall and the piston member is arranged longitudinally at least partially overlapping the contact area between the piston member and counter member during the operation of the intensifier piston arrangement.

According to an embodiment of the invention the counter member comprises a fuel conduit extending through the counter member into to the second work space and the fuel conduit is in direct flow communication with a fuel gallery of the at least one injection valve.

Preferably the fuel conduit is in connection with a fuel supply system through a one-way valve allowing fuel flow substantially only to the direction of the fuel conduit.

According to a preferred embodiment of the invention the first work space is arranged in flow connection with high pressure zone of fuel supply system and the second work space is arranged in flow connection with low pressure zone of fuel supply system. Additionally in this embodiment of the invention the intensifier piston arrangement is a flow fuse.

According to another embodiment of the invention the second work space is defined by the piston member and the counter member and the work space is arranged outside the piston member.

BRIEF DESCRIPTION OF DRAWINGS

In the following, the invention will be described with reference to the accompanying exemplary, schematic drawings, in which.

DETAILED DESCRIPTION OF DRAWINGS

Figure 1:
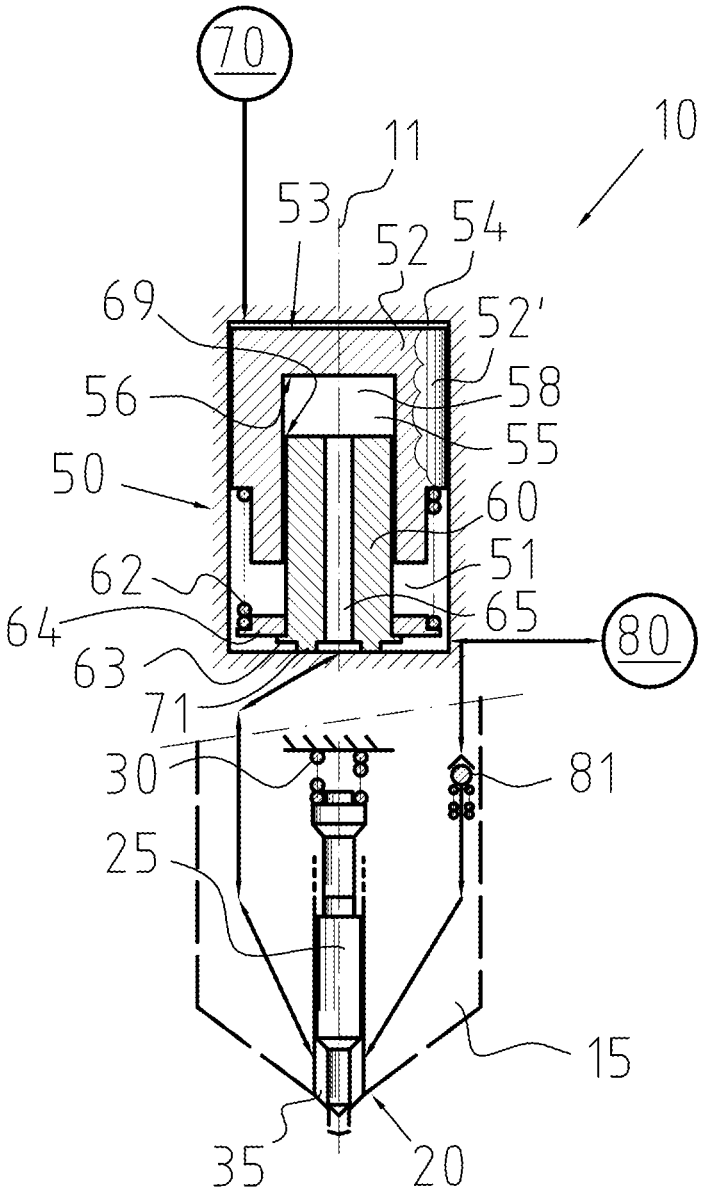
FIG. 1 illustrates a fuel injection arrangement according to an embodiment of the invention.

FIG. 1 illustrates a fuel injection arrangement 10 for piston engine according to an embodiment of the invention. The arrangement shown in FIG. 1 is strongly simplified and only those elements essential for understanding the operation of the invention are shown. The arrangement comprises at least one fuel injector 15 by means of which fuel may be injected into a combustion chamber of the engine (not shown). The fuel injector 15 comprises at least one fuel injection valve 20 arranged to meter the fuel into the combustion chamber of the engine. The injection valve may be of a type known as such, in which a needle 25 is spring-loaded 30 to a closing direction of the needle 25 and in which the needle is lifted against the spring load by means of fuel pressure in the fuel gallery 35 of the injection valve 20.

The fuel injection arrangement 10 further comprises an intensifier piston arrangement 50. The intensifier piston arrangement according to FIG. 1 comprises a piston space 51 and a piston member 52 arranged movably into the piston space 51. The piston member and the piston space are preferably of circular cross section. At least a part of its longitudinal outer surface 52' forms a contact area against the inner wall of the piston space 51. The contact area between the piston space inner wall and the piston member has a length in longitudinal direction 11.

The piston member has a face area 53 at its one end which is a projection perpendicular to the longitudinal axis 11 of the piston member/piston space. The face area at the one end is also called here as the first area of the piston member. The first area 53 is in a controllable connection with a work fluid system 70 which is arranged to have an effect on the first area 53 of the intensifier piston arrangement 10 in a manner of causing the piston member to move under increasing pressure of the work fluid against the first area 53. The piston member forms a first work space 54 between the first area 53 at the one end of the piston member and the inner wall of the piston space, above the piston member in the FIG. 1. The first area 53 at least partially borders the first work space of the intensifier piston arrangement. The first work space may be subjected to the pressure of the work fluid in the work fluid system 70 which makes the piston member 52 to move farther from the end of the piston space. The work fluid is preferably pressurized liquid. Most advantageously the work fluid system is the fuel feeding system of the engine.

At the second end of the piston member 52 there is arranged a cavity 55 extending inside the piston member 52. The cavity 55 has a second face area which is a projection perpendicular to the longitudinal axis 11 of the piston member. The second face area is also called here a second area 56 of the piston member 52, which is defined at least partly by the piston member 52 and the counter member 60 with their mutual contact rim 69 The second area partially borders a second work space 58 of the intensifier piston arrangement 50. In this embodiment of the invention the second work space 58 is arranged inside the piston member 52 and the intensifier piston arrangement comprises a counter member 60 arranged to extend into the cavity 55 inside the piston member 52 partially bordering the second work space 58. The cavity 55 and the counter member 60 define the second work space 58. The fitting of the cavity 55 into the counter member 60 is tight enough such that the second work space may be pressurized by the movement of the piston member 52 towards the counter member 60 by decreasing the volume of the second work space 58. The counter member 60 is arranged into the piston space 51 at the end opposite to the piston member 52. Since the cavity 55 is in the piston member 52 the total length i.e. the dimension in the longitudinal 11 direction of the intensifier piston arrangement is decreased and it is easier to be fitted into a fuel injector. In this way those fuel conduits in which the fuel pressure will be high during the injection, i.e. at the injection pressure, are all safely inside the injector. The counter member 60 is sealed against the surface of the piston space 51 by a shoulder 71 which separates the second work space 58 from the fuel supply system 80.

There is a spring element 62 arranged into the intensifier piston arrangement 50 so that it acts on the piston member 52 against the pressure force created by the work fluid in the first work space 54. In the embodiment of FIG. 1 the spring element is arranged to compress due to the movement of the piston member 52 towards the counter member 60. The main purpose of the spring is to return the piston member 52 back to its initial position after a work stroke towards the counter member 60. In FIG. 1 the counter member is a separate piece supported against the end wall of the piston space 51. The counter member is provided with a shoulder 63 against which a support plate 64 is arranged. The spring element 62 is arranged in this embodiment between the piston member 52 and the support plate 64 so that the spring force is transmitted through the plate 64 and the shoulder 63 to the counter member 60 and further to a body of the intensifier piston arrangement 50.

The counter member is arranged stationary during the operation of the intensifier piston arrangement 50 in relation to which the piston member is arranged to reciprocate. The cavity 55 is preferably a cylindrical space and thus also the counter member has preferably a cylindrical cross section. Preferably the piston member 52 and the counter member are rotationally symmetrical in respect to the longitudinal axis 11, which is thus also the central axis.

The counter member 60 is provided with a fuel conduit 65 through which the cavity 58 i.e. the second work space 58 is in flow connection with the injection valve 20 of the injector so that while the piston member 52 is pressed downwards by the pressure force created by the work fluid into the first work space 54 the fuel within the second work space 58 is pressed by the piston member 52 and its pressure is increased until the valve needle 25 is lifted by the pressure of the fuel and the injection is commenced.

The area $A_{60}$ of the cavity 55/counter member 60 is smaller than the area $A_{52}$ of the piston member 52. Thus the pressure $p_{58}$ created to the second work space 58 in the piston member 52 is proportional to the pressure $p_{54}$ in the first work space 54 and ratio of the area $A_{52}$ of the piston member 52 and the area $A_{60}$ of the counter member 60 according to the equation 1.

$$p_{58}=p_{54}\times A_{52}/A_{60} \quad (1)$$

Additionally the intensifier piston and the valve needle 20 are connected to a fuel supply system 80 through a one way valve 81 allowing fuel flow substantially only to the direction of the fuel conduit. In this way the fuel may enter into the fuel gallery of the nozzle and further to the second work space 58 between injections.

In the operation the piston member is reciprocated under control of the work fluid by intermittently applying fluid under high pressure to the first work space 54. Each stroke of the piston member 52 raises the pressure of the fuel in the second work space 58 inside the piston member and forces the injection valve nozzle 25 in an opening and closing movement. Very high injection pressures may be safely achieved without increasing the pressure of the work fluid excessively. For example if the pressure of the work fluid is 100 MPa and the area ratio is 3 the injection pressure will be 300 MPa. Particularly with the embodiment in which the intensifier piston is in the fuel nozzle the risk of leaking of such high pressure fuel is minimized since even if the injection pressure is extremely high (300 MPa in the example) the pressure in the external fuel ducts is considerably low.

The intensifier piston has a contact area between the piston space 51 inner wall and the piston member 52 longitudinally. The contact area is arranged at least partially overlapping the contact area between the piston member 52 and counter member 62 during the operation of the intensifier piston arrangement. In this way the longitudinal dimension of the intensifier piston may be decreased.

It should be noted that in the FIG. 1 the work fluid is pressurized fuel since the piston space 51 is in connection with the low pressure fuel zone.

Figure 2:
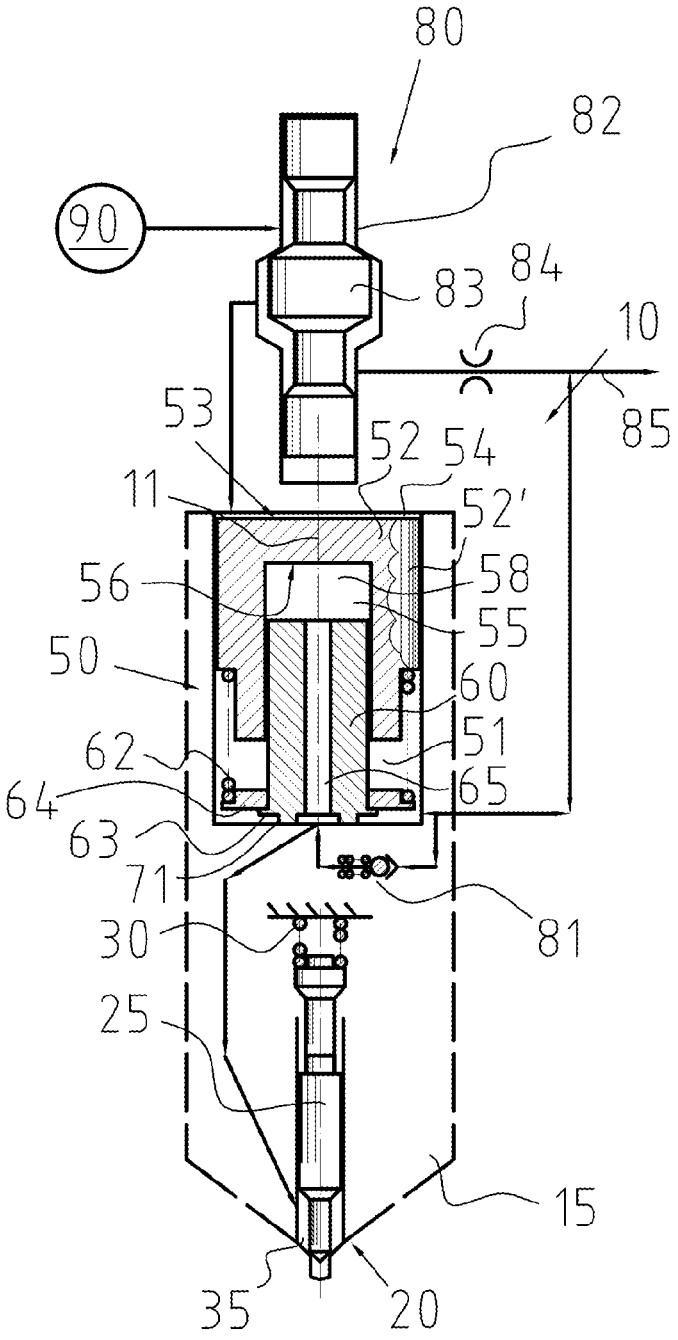
FIG. 2 illustrates a fuel injection arrangement according to another embodiment of the invention.

FIG. 2 shows another embodiment of a fuel injection arrangement according to the invention in which the intensifier piston arrangement is arranged in the fuel injector 15. The construction and operation of the intensifier substantially corresponds to that shown in FIG. 1. The fuel injection arrangement comprises a fuel supply system 80, which is provided with a so-called common rail system serving as a fuel source, which is illustrated with reference 90 and which is known as such for example in publication EP 0959245 B1. Each fuel injector 15 is provided with a valve arrangement 82. The valve arrangement may be arranged internally or externally to the fuel injector 15. The valve arrangement is provided with a fuel control arrangement 83, like a piston by means of which the fuel flow connection is connectable between the fuel source 90 and the first work space 54 of the intensifier piston arrangement 50. Thus, in this embodiment the fuel is used as the work fluid for operating the intensifier piston arrangement 50. The operation of the intensifier piston arrangement corresponds to that described in FIG. 1.

The fuel supply system is divided into two zones, a high pressure zone and a low pressure zone. In the embodiment shown in FIG. 2 the high pressure zone comprises the first work space 54, conduits between the first work space and the valve arrangement 82, the valve arrangement 82 and conduits upstream therefrom and the common rail system. The pressure of a leak fuel/return fuel from the valve arrangement 82 is reduced in a constriction 84 to a lower level and the zone after the constriction forms the low pressure zone of the fuel system. The actual pressure of the fuel in the low pressure zone is considerably lower than in the high pressure zone and the pressures may vary according to actual application.

The low pressure zone fuel conduit 85 is in connection with the piston space 51 of the intensifier piston arrangement at the opposite side of the piston member to the work space 54 so that possible fuel escaped from the work chambers 54, 58 of the intensifier piston arrangement may be led away.

Additionally the intensifier piston and the valve needle 20 are connected to a fuel supply system 80 through a one-way valve 81 allowing fuel flow substantially only to the direction of the fuel conduit. In this way the fuel may enter into the second work space 58 between injections. The fuel nozzle 25 is connected to the low pressure zone of the fuel supply system and the high pressure zone is separated by the intensifier piston arrangement 50 from the fuel nozzle 25 which minimizes the risk of leaking of the nozzle 25. Only the effective volume of the second work space 58 defines the maximum amount of possible leak. Even in the case of malfunction of the valve arrangement 82 the piston member 52 may only be driven once to its extreme position in which the second work space is as small as possible, and thus the intensifier piston arrangement 50 operates also as a flow fuse.

Figure 3:
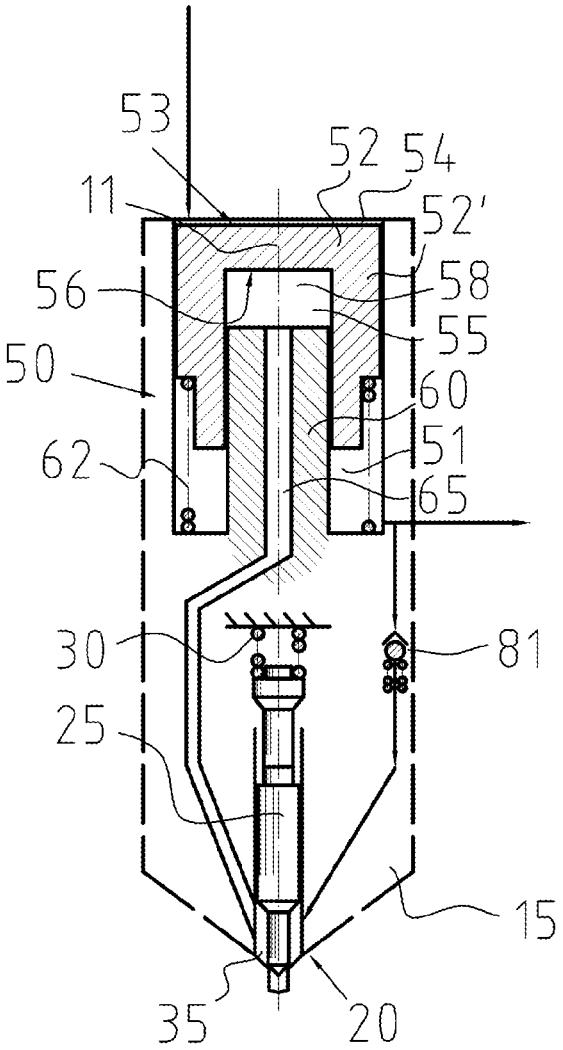
FIG. 3 illustrates an intensifier piston arrangement according to an embodiment of the invention.

In FIG. 3 there is shown and embodiment of the intensifier piston arrangement 50 the counter member 60 of which is a part of the body of the fuel injector 15. Otherwise it corresponds to that shown in FIG. 2.

Figure 4:
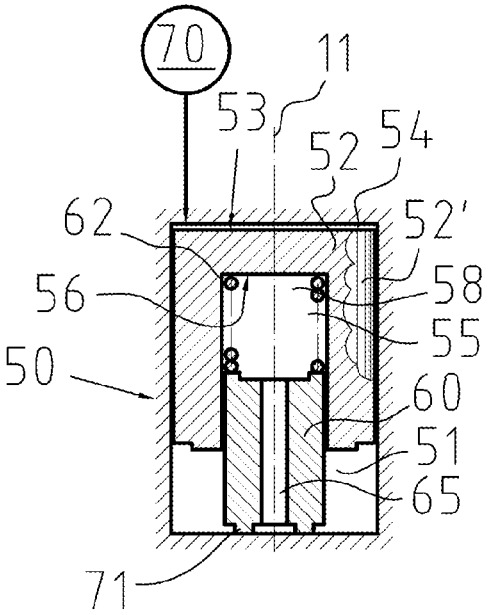
FIG. 4 illustrates an intensifier piston arrangement according to another embodiment of the invention.
Figure 5:
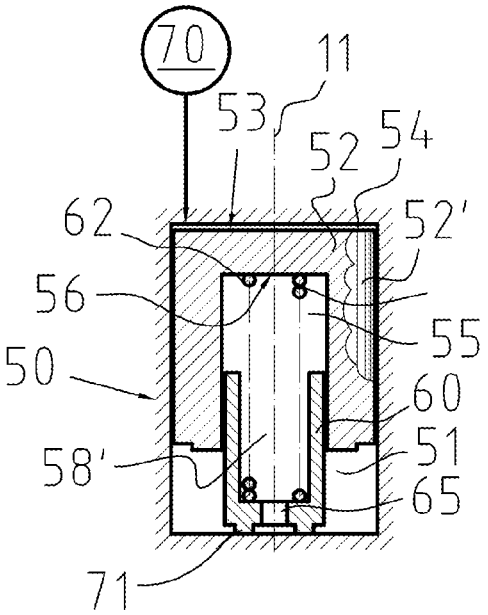
FIG. 5 illustrates an intensifier piston arrangement according to still another embodiment of the invention and FIG. 6 illustrates a fuel injection arrangement according to a still another embodiment of the invention.

In FIGS. 4 and 5 there are shown two different exemplary embodiments of the intensifier piston arrangement 50 according to the invention. In these embodiments the spring element 62 is arranged inside the second work space 58. Additionally in FIG. 5 there is shown an embodiment in which the counter member 60 is provided with a recess 58' at the side of the second work space 58.

Figure 6:
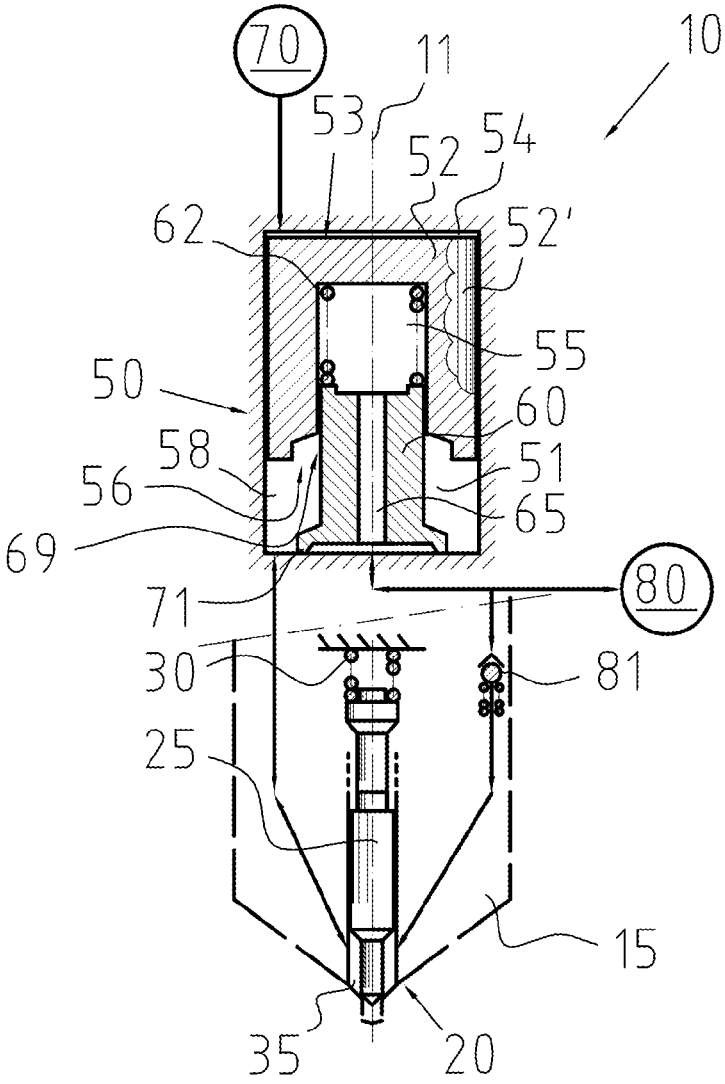

FIG. 6 illustrates a fuel injection arrangement 10 for piston engine according to another embodiment of the invention. The arrangement shown here is simplified and only those elements essential for understanding the operation of the invention are shown. The arrangement comprises at least one fuel injector 15 by means of which fuel may be injected into a combustion chamber of the engine (not shown). The fuel injector 15 comprises at least one fuel injection valve 20 arranged to meter the fuel into the combustion chamber of the engine. The injection valve may be of a type known as such, in which a needle 25 is spring loaded 30 to a closing direction of the needle 25 and in which the needle is lifted against the spring load by means of fuel pressure in the fuel gallery 35 of the injection valve 20.

The fuel injection arrangement 10 comprises an intensifier piston arrangement 50. The intensifier piston arrangement according to the embodiment of FIG. 6 comprises a piston space 51 and a piston member 52 arranged movably into the piston space 51. The piston member 52 and the piston space are preferably of circular cross section. At least a part of its longitudinal outer surface 52' forms a contact area against the inner wall of the piston space 51. The contact area between the piston space inner wall and the piston member has a length in longitudinal direction 11.

The piston member has a face area 53 at its one end which is a projection perpendicular to the longitudinal axis 11 of the piston member/piston space. The face area at the one end is also called here the first area of the piston member. The first area 53 is in a controllable connection with a work fluid system 70 which is arranged to have an effect on the first area 53 of the intensifier piston arrangement 10 in a manner of causing the piston member to move under increasing pressure of the work fluid against the first area 53. The piston member forms a first work space 54 between the first area 53 at the one end of the piston member and the inner wall of the piston space, above the piston member in the FIG. 6. The first area 53 at least partially borders the first work space of the intensifier piston arrangement. The first work space may be subjected to the pressure of the work fluid in the work fluid system 70 which causes the piston member 52 to move farther from the end of the piston space. The work fluid is preferably pressurized liquid. Most advantageously the work fluid system is the fuel feeding system of the engine and thus the work fluid is pressurized fuel.

At the second end of the piston member 52 there is arranged a cavity 55 extending inside the piston member 52. The intensifier piston arrangement comprises a counter member 60 which is arranged into the piston space 51 to extend at least partly into the cavity 55 inside the piston member 52. In the embodiment of FIG. 6 the piston member rim outside the cavity 55 has a second face area which is a projection perpendicular to the longitudinal axis 11 of the piston member. The second face area is also called here a second area 56 of the piston member 52. In this case the second area 56 is defined at least partly by the piston member 52 and the counter member 60 with their mutual contact rim 69. The second area partially borders a second work space 58 of the intensifier piston arrangement 50, which is in this embodiment formed of annular space between the counter member 60 and the inner surface of the piston space 51. In this embodiment of the invention the second work space 58 is arranged outside the piston member 52 partially bordering the second work space 58 by its second face area. The piston space 51 at the side of the second area 56 of the piston member 52 (below the piston member in the FIG. 6) and the counter member 60 define the second work space 58. The fitting of the cavity 55 into the counter member 60 is tight enough such that the second work space may be pressurized by the movement of the piston member 52 towards the counter member 60 by decreasing the volume of the second work space 58. The counter member 60 is arranged into the piston space 51 at the end opposite to the piston member 52. Since the piston space 51 operates both as the first work space and the second work space the total length, i.e. the dimension in the longitudinal direction 11 of the intensifier piston arrangement is decreased and it is easier to be fitted into a fuel injector. In this way those fuel conduits in which the fuel pressure will be high at the injection pressure are all safely inside the injector.

There is a spring element 62 arranged into the intensifier piston arrangement 50 so that it acts on the piston member 52 against the pressure force created by the work fluid in the first work space 54. In the embodiment of FIG. 6 the spring element is arranged to compress due to the movement of the piston member 52 towards the counter member 60. The main purpose of the spring is to return the piston member 52 back to its initial position after a work stroke towards the counter member 60. In FIG. 6 the counter member is a separate piece supported against the end wall of the piston space 51. The spring element 62 is arranged in this embodiment between the piston member 52 and the counter member 60 so that the spring force is transmitted to the counter member 60 and further to a body of the intensifier piston arrangement 50. The counter member 60 is sealed against the surface of the piston space 51 by a shoulder 71 which separates second work space 58 from the fuel supply system 80.

The counter member is arranged stationary during the operation of the intensifier piston arrangement 50 in relation to which the piston member is arranged to reciprocate. The cavity 55 is preferably a cylindrical space and thus also the counter member has preferably a cylindrical cross section. Preferably the piston member 52 and the counter member are rotationally symmetrical in respect to the longitudinal axis 11, which is thus also the central axis.

The annular second work space 58 is in flow connection with the injection valve 20 of the injector so that while the piston member 52 is pressed downwards by the pressure force created by the work fluid into the first work space 54 the fuel within the second work space 58 is pressed by the piston member 52 and its pressure is increased until the valve needle 25 is lifted by the pressure of the fuel and the injection is commenced.

The area of the piston member 53 towards to annular second work space 58 is smaller than the area of the piston member 52 at its first work space side. Thus the pressure created to the second work space 58 is proportional to the pressure in the first work space and the ratio of the area of the piston member at the work space side and the area the piston member at the second work space side.

Additionally the intensifier piston and the valve needle 20 are connected to a fuel supply system 80 through a one-way valve 81 allowing fuel flow substantially only to the direction of the fuel conduit. In this way the fuel may enter into the fuel gallery of the nozzle and further to the second work space 58 between the injections.

In the operation the piston member is reciprocated under control of the work fluid by intermittently applying fluid under high pressure to the first work space 54. Each stroke of the piston member 52 raises the pressure of the fuel in the second work space 58 and forces the injection valve nozzle 25 in an opening and closing movement. Very high injection pressures may be safely achieved without increasing the pressure of the work fluid excessively. For example if the pressure of the work fluid is 100 MPa and the area ratio is 3 the injection pressure will be 300 MPa. Particularly with the embodiment in which the intensifier piston is in the fuel nozzle the risk of leaking of such high pressure fuel is minimized since even if the injection pressure is extremely high (300 MPa in the example) the pressure in external fuel ducts is considerably low.

The intensifier piston has a contact area between the piston space 51 inner wall and the piston member 52 longitudinally. The contact area is arranged at least partially overlapping the contact area between the piston member 52 and the counter member 62 during the operation of the intensifier piston arrangement. In this way the longitudinal dimension of the intensifier piston may be decreased.

It should be noted that in the FIG. 6 the work fluid is pressurized fuel. The counter member 60 is provided with a fuel conduit 65 through which the cavity 55 is in connection with the low pressure fuel zone. This allows the reciprocating movement of the piston member 52.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible.

The invention claimed is:

1. A fuel injection arrangement for piston engine comprising at least one fuel injector means of which fuel may be injected into a combustion chamber of the engine, the fuel injector comprising at least one fuel injection valve arranged to meter the fuel into the combustion chamber, the fuel injection arrangement further comprising an intensifier piston arrangement comprising a piston space and a piston member therein having a first area which is arranged to be influenced by a work fluid and which first area at least partially borders a first work space of the intensifier piston arrangement; and the piston member having a second area which at least partially borders a second work space of the intensifier piston arrangement, and the intensifier piston arrangement comprises a counter member and the piston member is provided with a longitudinally extending cavity providing a space into which the counter member is arranged to extend at least partly, and the second area is at least partly defined by the piston member and the counter member, wherein the second work space is defined by the cavity in the piston member and the counter member and the second work space is arranged inside the piston member; and the second work space being arranged in flow connection with the at least one injection valve of the injector so that the valve needle is arranged to be lifted by the pressure or the fuel in the second work space.

2. A fuel injection arrangement according to claim 1, wherein the piston member has a cylindrical body comprising a first end and a second end into which second end a longitudinally extending cavity is arranged.

3. A fuel injection arrangement according to claim 1 wherein the contact area between the piston space inner wall and the piston member is arranged longitudinally at least partially overlapping the contact area between the piston member and counter member during the operation of the intensifier piston arrangement.

4. A fuel injection arrangement according to claim 2, wherein the counter member comprises a fuel conduit extending through the counter member into to the second work space and that the fuel conduit is in direct flow communication with a fuel gallery of the at least one injection valve.

5. A fuel injection arrangement according to claim 4, wherein the fuel conduit is in connection With a fuel supply system through a one way valve allowing fuel flow substantially only to the direction of the fuel conduit.

6. A fuel injection arrangement according to claim 1, wherein the first work space is arranged in flow connection with the high pressure zone of the fuel supply system and the second work space is arranged in flow connection with the low pressure zone of the fuel supply system.

7. A fuel injection arrangement according to claim 6, wherein the intensifier piston arrangement operates also as a flow fuse.

8. A fuel injection arrangement according to claim 1, wherein the intensifier piston arrangement is arranged in the fuel injector.

9. A fuel injection arrangement according to claim 2, wherein the contact area between the piston space inner wall and the piston member is arranged longitudinally at least partially overlapping the contact area between the piston member and counter member during the operation of the intensifier piston arrangement.

10. A fuel injection arrangement according to claim 2, wherein the intensifier piston arrangement is arranged in the fuel injector.

11. A fuel injection arrangement according to claim 3, wherein the intensifier piston arrangement is arranged in the fuel injector.

12. A fuel injection arrangement according to claim 4, wherein the intensifier piston arrangement is arranged in the fuel injector.

13. A fuel injection arrangement according to claim 5, wherein the intensifier piston arrangement is arranged in the fuel injector.

14. A fuel injection arrangement according to claim 6, wherein the intensifier piston arrangement is arranged in the fuel injector.

15. A fuel injection arrangement according to claim 7, wherein the intensifier piston arrangement is arranged in the fuel injector.

* * * * *